United States Patent [19]

Seeley

[11] Patent Number: 4,572,808

[45] Date of Patent: Feb. 25, 1986

[54] PUMP ARRANGEMENT

[76] Inventor: Frederic F. Seeley, 3 Rothesay Ave., St. Marys, Australia

[21] Appl. No.: 629,279

[22] Filed: Jul. 9, 1984

[30] Foreign Application Priority Data

Jul. 22, 1983 [AU] Australia ..... PG 0442

[51] Int. Cl.[4] ..... B01F 3/04

[52] U.S. Cl. ..... 261/29; 417/362

[58] Field of Search ..... 261/29; 417/362

[56] References Cited

U.S. PATENT DOCUMENTS

| | | | |
|---|---|---|---|
| 2,641,404 | 6/1953 | Schwarz | 417/362 |
| 2,730,905 | 1/1956 | Pence | 261/29 |
| 2,751,760 | 6/1956 | Williams, Jr. | 220/307 |
| 2,757,613 | 8/1956 | Dry | 417/362 |
| 2,813,491 | 11/1957 | Herreshoff et al. | 417/362 |
| 2,998,714 | 9/1961 | Bonzer | 261/29 |
| 3,015,408 | 1/1962 | Campbell et al. | 220/307 |
| 4,269,573 | 5/1981 | Goode | 417/362 |
| 4,338,264 | 7/1982 | Seeley | 261/29 |

*Primary Examiner*—Tim Miles

*Attorney, Agent, or Firm*—Brown, Martin & Haller

[57] ABSTRACT

The fan of an evaporative cooler rotates about a generally horizontal axis, and its shaft carries a "driving" wheel which engages a driven wheel on the upper end of the pump spindle, which extends vertically downwardly to the base tank. The pump is pivotally mounted to the assembly of the base tank, cabinet and fan housing, and a releasable spring extending between the pump and that assembly retains the two wheels in driving engagement. The pump can be lifted out of the cabinet by simply releasing the spring.

7 Claims, 3 Drawing Figures

PUMP ARRANGEMENT

This invention relates to improvements in an evaporative cooler, specifically to the pump thereof, and the drive and mounting arrangement therefor.

BACKGROUND OF THE INVENTION

An evaporative cooler usually has a fan contained within a fan housing, and this blows air through a pad over which water flows from water distribution means, thereby evaporating the water and reducing the sensible heat of the air. The water flows from the pad back into a tank at the base of the cooler, and is recirculated by means of a pump.

In the most efficient design of evaporative coolers yet to be produced, there has been a common axis of rotation of motor, fan and pump, and since the pump normally depends into the base tank, this axis has been generally vertical. This is clearly shown in U.S. Pat. No. 4,338,264 which issued in the name of the Applicant herein. However, as can be clearly seen in that Patent specification, pump maintenance requires considerable dismantling of the cooler, and the main object of this invention is to provide improvements whereby a pump is quickly and easily removed.

Another object of this invention is to provide improvements whereby the design of the pump is simplified, its cost is low, and it can be readily removed for maintenance purposes.

BRIEF SUMMARY OF THE INVENTION

In this invention, the fan of an evaporative cooler rotates about a generally horizontal axis, and its shaft carries a "driving" wheel which engages a driven wheel on the upper end of the pump spindle, which extends vertically downwardly to the base tank. The pump is pivotally mounted to the assembly of the base tank, cabinet and fan housing, and a releasable spring extending between the pump and that assembly retains the two wheels in driving engagement. The pump can be lifted out of the cabinet by simply releasing the spring.

More specifically, the invention consists of improvements which comprise pivotal mounting means coupling the pump to an assembly of a base tank, cabinet and fan housing, a driving wheel on the fan shaft, a driven wheel on the pump spindle, and releasable spring means extending between the pump and assembly releasably retaining the driven wheel in driving engagement with the driving wheel.

Separate motors have sometimes been used for driving pumps, but these are expensive and are subject to corrosion because they necessarily contain ferrous materials. This invention obviates the need for a separate motor, and in one embodiment of this invention the driving wheel on the outer end of the fan shaft is provided with a friction drive annular surface which frictionally engages a driven annular surface on the driven wheel on the pump spindle. This may be a small tyre, for example, an "O" ring contained within a groove surrounding the driven wheel. Not only can the entire pump assembly be very simply retained in position by means of a tension spring intermediate the pivotal mounting and the drive means, but removal of the fan is also simplified by lifting the spring away from the scroll.

If the drive means which is used is of the friction type, and that is all that is required for a small pump of the type described herein, the driven wheel, in one embodiment, comprises two diameter portions, so that the pump can be driven at different speeds for different size units. By this invention, possible electrical hazard is reduced, and the need for a flexible pump drive (as sometimes used), is also avoided. The invention can be applied for any angle of inclination of the fan, from vertical to horizontal.

DETAILED DESCRIPTION OF THE DRAWINGS

Figure 1:
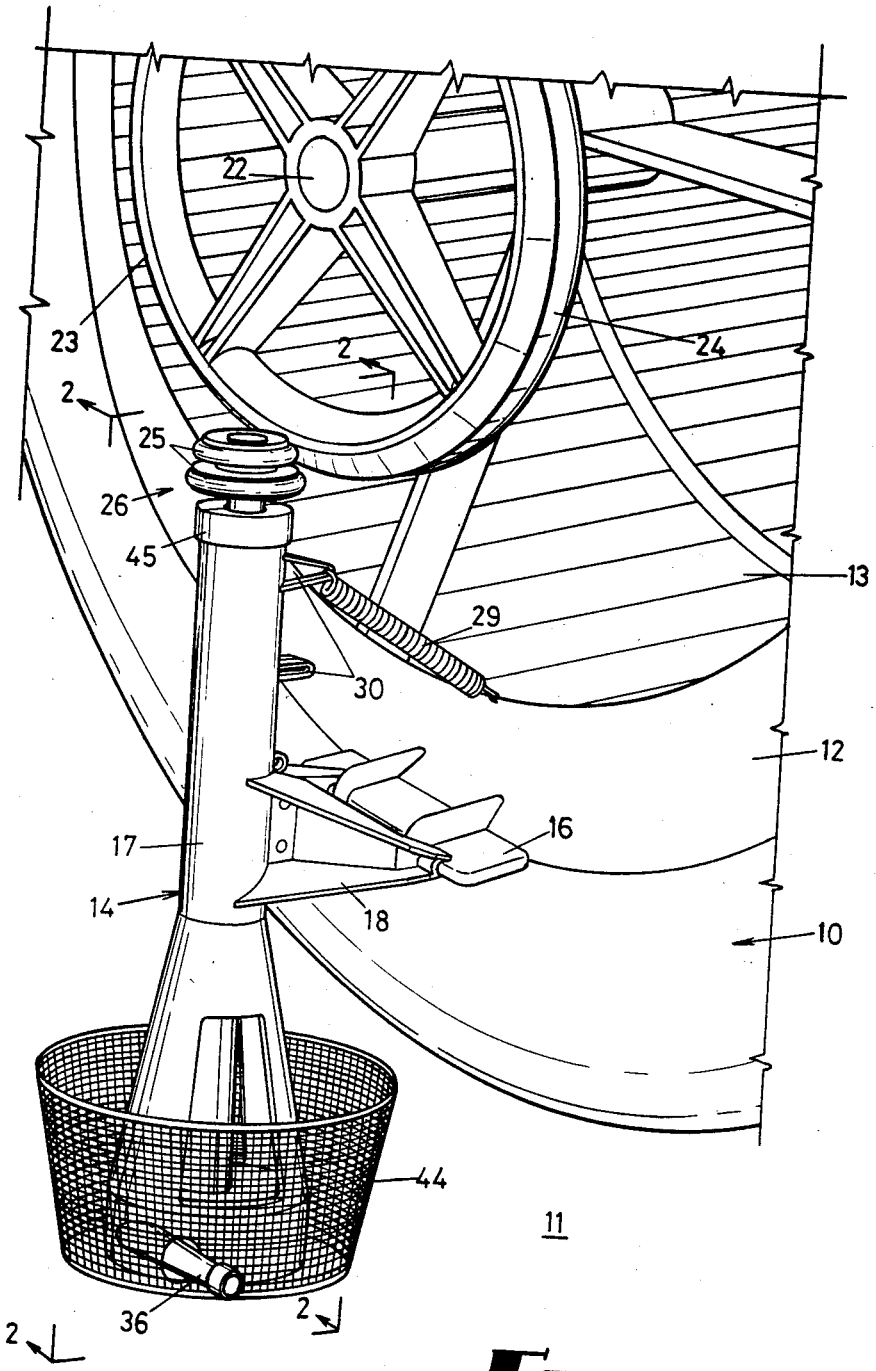
Figure 2:
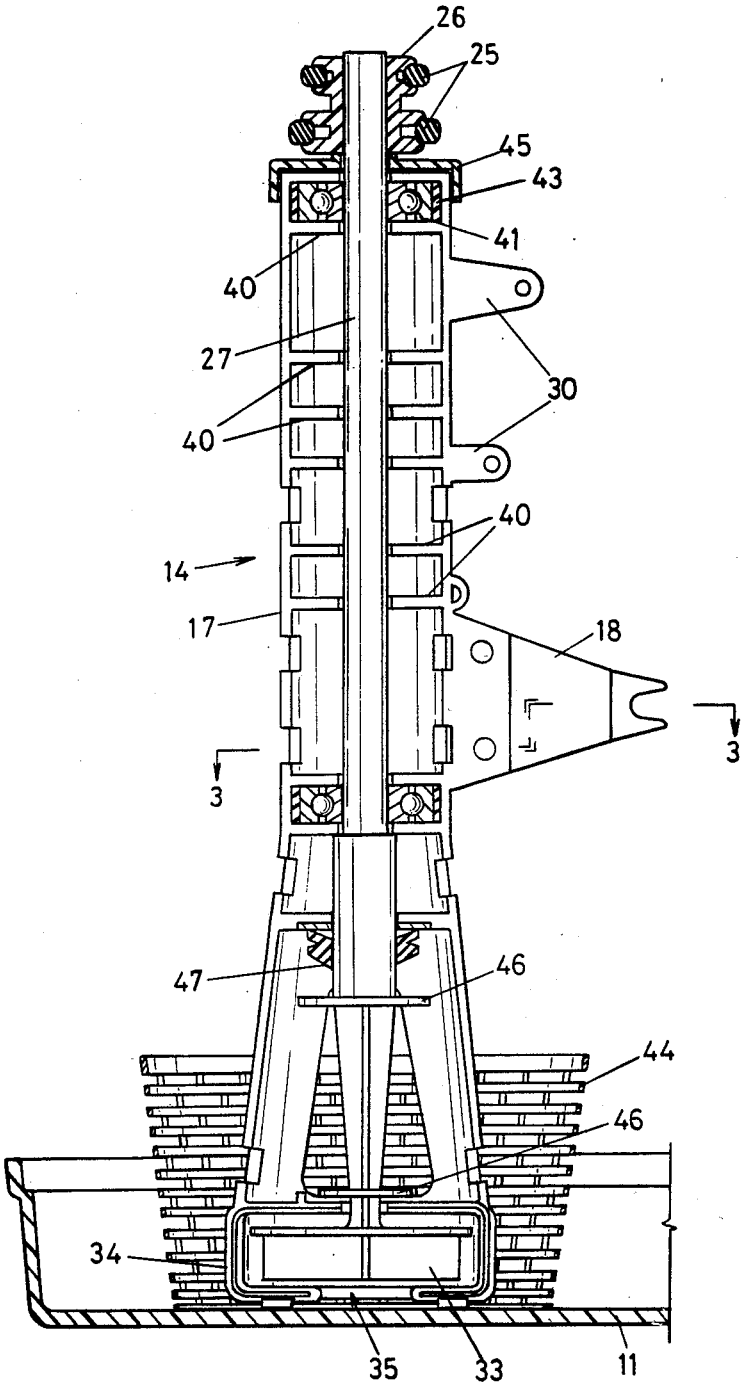
Figure 3:
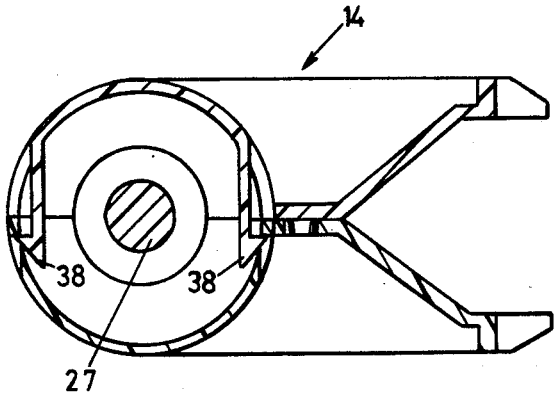

An embodiment of the invention is described hereunder in some detail with reference to, and is illustrated in, the accompanying drawings, in which:

FIG. 1 is a fragmentary perspective view which illustrates a pump pivotally mounted to the fan housing of a base tank, cabinet and fan housing assembly, FIG. 2 is a section taken on plane 2-2-2-2 of FIG. 1, and FIG. 3 is a cross-section taken on line 3—3 of FIG. 2.

In this embodiment an evaporative cooler has an assembly 10 which comprises a base tank 11, a cabinet (not shown), and a fan housing 12 containing a centrifugal type fan impeller 13, which is driven by a motor (not shown), and the cooler also contains a pump 14. The fan housing 12 is a scroll which has an abutment lug 16 projecting therefrom, and the stator 17 of the pump has a pair of abutment flanges 18 each terminating in a "U" shaped groove 19, the surfaces of which abut a projecting edge of the abutment lug 16 to provide a pivotal mounting for the pump.

The abutment lug 16 is located vertically below the shaft 22 of the fan 13, and that shaft 13 has on it a driving wheel 23 with a part-conical surface 24, the part-conical surface frictionally engaging a tyre 25 of a driven wheel 26 on the upper end of a spindle 27 of the pump 14. Engagement is retained by a spring 29 which engages the mouth of the scroll 12 and one of two spring lugs 30 on the stator 17 of the pump 14. In this invention, one pump may be used for varying the sizes of evaporative cooler units, and for this reason there are provided two alternative spring lugs 30 on the stator 17 of the pump. Furthermore, the driven wheel 26 has two diameter portions, and by simply lifting it from the end of the spindle 27 and inverting it, the smaller or larger portion may selectively be used for engagement with the part-conical surface 24 of the pulley 23.

The lower end of the spindle 27 carries a pump impeller 33 on it, and this is within a housing 34 which, as seen in FIG. 2, forms part of stator 17, and which has an inlet opening 35 directed downwardly so that the water entry to the pump is through the bottom of the housing and this provides maximum usage of available water. The outlet opening 36 is connected to water distribution means by a conduit (not shown), in accordance with known art. The spindle, impeller, stator and driven wheel are all formed from polymeric material, the stator 17 being formed in two half stator portions which clip together face to face in a diametral plane with resilient clips 38 so that there is a minimum usage of ferrous material. The inner surface of the stator is provided with a plurality of bearing support flanges 40, and these are selectively engaged by bearings 41, the arrangement being such that both the stator 17 and spindle 27 can be reduced in length if it is required to be used on a smaller pump, for example in a smaller size evaporative cooling unit. The bearings 41 which are used may be plain journalled bearings, but, as shown, in this embodiment use is made of ball races. Alternatively use can be made of one plain bearing and one ball race.

Each ball race is itself contained in a rubber sleeve 43 to reduce bearing noise, and provide friction to prevent the bearing from rotating within the housing, and the spring is so oriented with respect to the driving pulley, that the bevel surface thereon applies a downward pressure as well as a radial pressure, and this overcomes a difficulty otherwise encountered in the development of bearing noise in the pump.

The lower end of the pump is itself housed within a cup-like filter 44. The invention includes further important features, including an inverted cup-like top cap 45 which seals the pump against ingress of water and assists in retaining the half portions together of stator 17, and circular deflectors 46 moulded on the pump spindle 27 to deflect water which might otherwise tend to climb the rotor as the pump is operating. A "V" seal 47 further inhibits entry of moisture into bearings 41.

A consideration of the above embodiment will indicate that the invention is exceedingly simple, the pump is quickly and easily replaced or removed for maintenance purposes, a single set of mouldings can be used for various size air conditioners, bearing noise is greatly reduced by the application of an axial force to the rotor, and the cost is low. Although the driving surface 24 of wheel 23 is described as part-conical, use may alternatively be made of a flat annular driving surface.

I claim:

1. Improvements in an evaporative cooler which comprises a base tank, cabinet and fan housing assembly, a shaft within the fan housing carrying a fan impeller and journaled in bearings for rotation about a generally horizontal axis, drive means coupled for drive to the fan shaft, a pump within the cabinet having a pump stator and a pump spindle, and bearings in the pump stator which journal the pump spindle for rotation about a generally vertical axis, the pump having an inlet and an outlet, and water distribution means, the pump inlet opening into the base tank, and conduit means joining the pump outlet to the water distribution means, said improvements comprising abutment means projecting from the pump stator and further abutment means projecting from the fan housing assembly, one of said abutment means terminating in a 'U'-shaped groove surface and the other said abutment means terminating in a hinging edge which hingedly abuts the 'U'-shaped groove surface to form unattached pivotal mounting means coupling the pump to the assembly, a driving wheel on said fan shaft, a driven wheel on said pump spindle, and a releasable spring extending between said pump and assembly releasably retaining the driven wheel in driving engagement with the driving wheel and also releasably retaining said projecting edge in its abutment with said groove surface.

2. Improvements according to claim 1 wherein said driving wheel has a part-conical surface and the driven wheel frictionally engages said part-conical surface.

3. Improvements according to claim 1 wherein said driven wheel comprises a pair of tyres of different diameters and is reversible on said spindle, thereby providing pump speed selection means.

4. Improvements according to claim 1 wherein said abutment means comprise a pair of flanges projecting from the pump stator and terminating in said 'U'-shaped groove surface, and further comprises a lug projecting from the pump housing which terminates in said hinging edge.

5. Improvements according to claim 1 wherein said pump stator comprises a pair of half stator portions, and resilient clips extending from one of the half stator portions engage the other half stator portion and retain the half stator portions together face to face in a diametrical plane as an assembly.

6. Improvements according to claim 5 wherein said stator comprises a plurality of support flanges selectively engaged by said bearings.

7. Improvements according to claim 5 wherein the lower end of the stator comprises a pump housing containing a pump impeller, said inlet opening being an opening in the base of housing and opening into said base tank.

* * * * *

UNITED STATES PATENT AND TRADEMARK OFFICE

CERTIFICATE OF CORRECTION

PATENT NO. : 4,572,808

DATED : February 26, 1986

INVENTOR(S) : Frederic Frank Seeley

It is certified that error appears in the above-identified patent and that said Letters Patent are hereby corrected as shown below:

Immediately below the inventor's name and address data, insert --Assignee: F. F. Seeley Nominees Pty. Ltd.--

Signed and Sealed this

Twenty-eighth Day of October, 1986

[SEAL]

*Attest:*

DONALD J. QUIGG

*Attesting Officer*

*Commissioner of Patents and Trademarks*